United States Patent [19]

Kropp

[11] Patent Number: 4,738,279

[45] Date of Patent: Apr. 19, 1988

[54] MULTIWAY VALVES WITH LOAD FEEDBACK

[75] Inventor: Walter Kropp, Sulzbach/Main, Fed. Rep. of Germany

[73] Assignee: Linde Aktiengesellschaft, Wiesbaden, Fed. Rep. of Germany

[21] Appl. No.: 937,706

[22] Filed: Dec. 4, 1986

[30] Foreign Application Priority Data

Dec. 17, 1985 [DE] Fed. Rep. of Germany ..... 3544606

[51] Int. Cl.[4] ..... F15B 13/02

[52] U.S. Cl. ..... 137/596; 60/452; 91/446; 137/625.68

[58] Field of Search ..... 60/452; 137/596, 625.68, 137/596.2; 91/446

[56] References Cited

U.S. PATENT DOCUMENTS 4,617,798 10/1986 Krusche et al. ..... 137/625.68 X

*Primary Examiner*—Gerald A. Michalsky

*Attorney, Agent, or Firm*—Buell, Ziesenheim, Beck & Alstadt

[57] ABSTRACT

A multiway valve is provided having a load feedback wherein a pressure-reducing element that reduces the pressure conveyed to a connection through the valve with a control pressure signal line is controlled as a function of the displacement of a valve piston in the multiway valve.

6 Claims, 1 Drawing Sheet

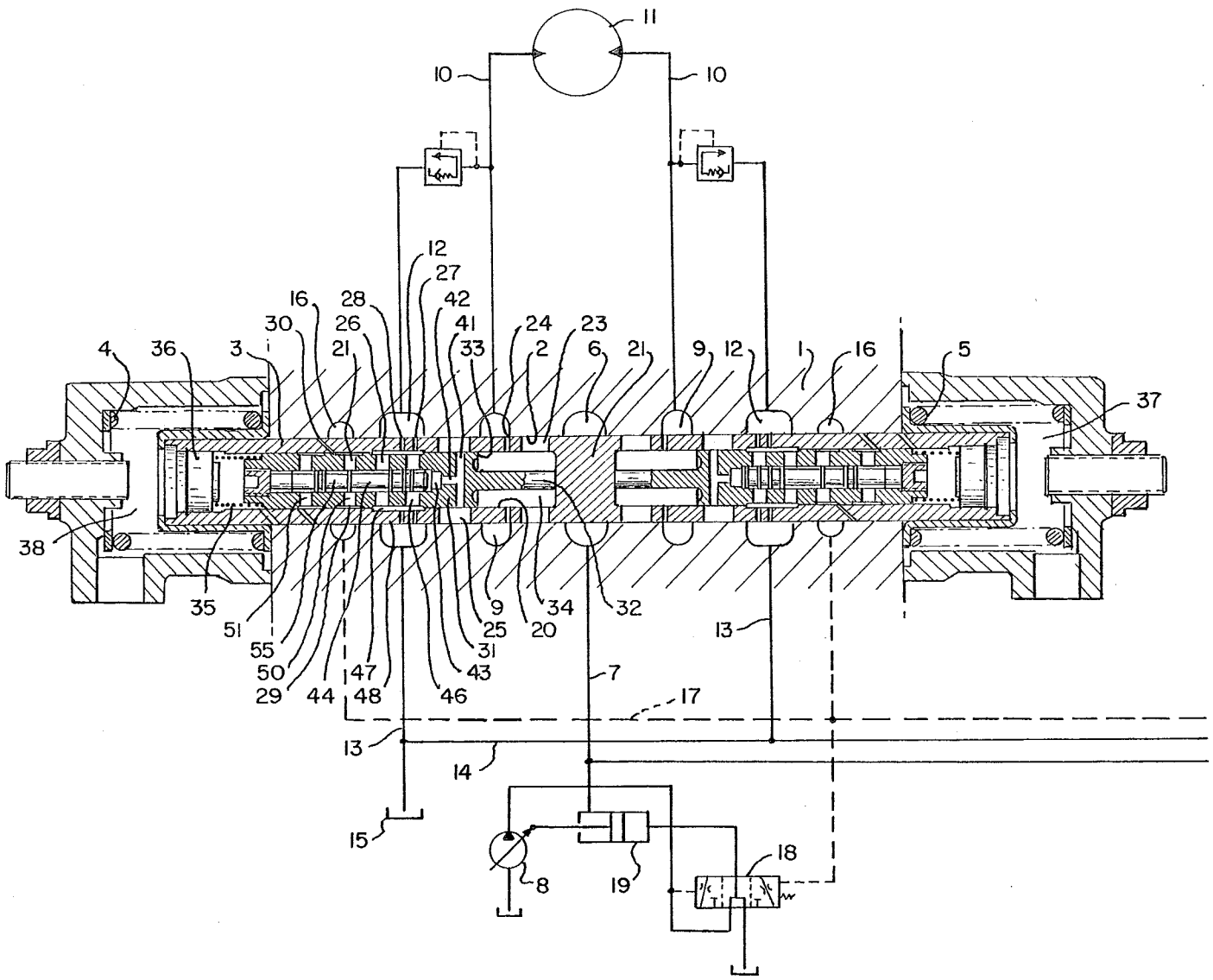
37
5
16
1
12
9
21
23
6
24
2
33
41
42
27
12
28
26
21
16
30
3
36
4
38
35
51
55
50
29
44
47
48
13
17
7
32
34
20
9
25
31
43
46
14
13
15
18
19
8
10
11
10

MULTIWAY VALVES WITH LOAD FEEDBACK

This invention relates to multiway valves with load feedback and more particularly to a multiway valve for a load sensing regulated drive system.

Multiway acting valves for a load sensing regulated drive system are known. A typical such multiway valve has a housing with a longitudinal bore and a first annular groove connected with a pump, a pair of second annular grooves connected with each side of the consumer to be controlled, a pair of third annular grooves connected with a drain line, on each side of the second grooves a pair of fourth annular grooves connected with a control pressure signal line, on each side of the third grooves and a valve piston having a longitudinal hole on at least one side into which transverse holes in the piston empty, and through which selected annular grooves may be connected.

If a hydraulic motor is switched on in the familiar load-sensing systems, one that drives a machine with a high mass moment of inertia and must accelerate it upon being switched on, e.g., a hydraulic motor for the rotating mechanism of a dredger, a high torque is required for the acceleration and consequently a high pressure will build up in front of the consumer, even if it was regulated only to a small final rpm. The high pressure is fed back through the load-sensing control pressure signal line to the power control element of the pump, which sets the pump to a smaller stroke volume per revolution because at a high stroke volume per revolution the product of high delivery stream and high delivery pressure yields a higher power output than that which the driving primary power source is capable of yielding. In the operating state indicated above, however, a high pressure is required only together with a small partial stream and consequently a considerably lower output is required than that which corresponds to the product of the pressure in front of the switched-on consumer and the full delivery volume of the pump. Actually, the pump must also generate this pressure in order to make the appropriate pressure available to the consumer. That is, in the hydraulic control devices known to date with a loadsensing pump, the consumer that is being driven, e.g., the said rotation mechanism of a dredger, is accelerated with the maximum possible operating pressure to the desired velocity value. It is not possible to set a maximum pressure that is variable as a function of the desired value.

The invention proposes a multiway valve for a control device with load sensing with a consumer pressure restricted as a function of the drive function, i.e., with superimposed moment control, in which case the multiway valve is to be simple in construction, preferably no additional control mechanisms or link motion parts are to be required, apart from a modification of the control valve piston of the multiway valve and the pertinent internal components.

The problem is solved by providing in the connection produced by the annular groove connected with the consumer with the annular groove connected with the control pressure signal line, a pressure reducing element that reduces the pressure conveyed to the connection with the control pressure signal line and which is controlled as a function of the displacement path of the valve piston. That is, an invariable restrictor (fixed aperture) and an adjustable (controllable) throttling cross section are located in the valve piston, where the pressure signal for the LS-regulator is picked off in the connection between this fixed aperature and this controllable throttling cross section, and this signal is dependent in this case not only on the load pressure, but also on the displacement path of the valve piston. The result is that in a control range, the size of which is determined by the structural dimensions of the multiway valve, the pressure flowing to the consumer and thus the torque on the rotating shaft in the case of a hydraulic motor can be controlled as a function of the displacement path of the valve piston. In this said region of the displacement path the pressure level in the hydraulic unit cannot be higher than the load pressure of the one of the parallel-connected consumers that presents the highest load pressure, so that the drive is not loaded unnecessarily highly. That is, the increase in the pressure plotted over the displacement path of the valve piston can be flattened out in the desired manner in a given displacement path region.

According to another expedient implementation of the invention, a 3-connection/2-position multiway valve is located in the valve piston and it interrupts the connection between the said throttling cross sections and the control pressure signal line if a consumer that is switched parallel to the consumer controlled with this multiway valve carries a higher load pressure than the consumer controlled by this multiway valve.

In the foregoing general description I have set out certain objects, purposes and advantages of this invention. Other objects, purposes and advantages of this invention will be apparent from a consideration of the following description and the accompanying drawing in which:

The drawing illustrates in fragmentary longitudinal section the valve of this invention with schemetic drive system.

A longitudinal bore 2 is provided in a housing 1 and a valve piston 3 is capable of being displaced in bore 2 against the force of either spring 4 or spring 5. An annular groove 6 is provided in the middle of the longitudinal bore 2 and it is connected through a delivery line 7 with an adjustable pump 8. Additional annular grooves are provided symmetrically to this annular groove 6, i.e., starting from the annular groove 6, first there are two annular grooves 9 that are each connected through a line 10 with a consumer 11. Then there are another two annular grooves 12 that are each connected through a line 13 with the pressureless drain collecting line 14, which leads to the tank 15. Two annular grooves 16 are also provided and they are connected with the control pressure signal line 17, which leads to a spring-loaded control pressure chamber of a hydraulically controlled pump-adjusting multiway valve 18, whose second control pressure chamber is connected to the delivery line 7 and which controls the pressure loading of the pump-regulating cylinder 19, which is designed as a differential piston cylinder.

A longitudinal hole 20, designed as a blind hole, is provided in the valve piston 3 on each side, in which case a central partition 21 is present in the middle of the valve piston 3 between these two holes due to the design as a blind hole.

From the middle out, several transverse holes are provided alongside each other in the valve piston 3, first the transverse holes 23, than narrower transverse holes 24, then transverse holes 25 and then two narrow transverse throttling holes 27 and 28 adjacent to each other and emptying into an annular groove 26, and finally oblique transverse holes 30 dipping into an annular groove 29.

An auxiliary piston 31 is displaceable in the longitudinal hole 20; it is supported with a distance vertical journal 32 against the central partition 21 and forms a throttle edge 33 with its front wall.

A connecting space 34 is provided in the longitudinal hole 20 in front of the end face of the auxiliary piston 31. The auxiliary piston 31 is capable of moving against the force of a spring 35, which rests against a stopper 36.

The valve piston 3 can be displaced in the longitudinal bore 2 by loading one of the pressure chambers 37 or 38 and thus the pertinent end face of the valve piston 3 with pressure. When the valve piston 3 moves to the right in the drawing, the transverse hole 23 comes into connection with the annular groove 6 and thus with the delivery line 7 or the pump 8 and thus the connecting space 34 becomes connected with the delivery line 7, while the transverse holes 25 simultaneously become connected with the annular groove 9 on the left-hand side of the housing is the drawing, such that the pressure medium flows from the pump 8 through the delivery line 7, the annular groove 6, the transverse hole 23, the connecting space 34, the transverse hole 25, the annular groove 9, and the line 10 to the consumer 11, in which case the auxiliary piston 31 is shifted against the force of spring 35 by the pressure medium under pressure in the connecting chamber 34. On the right-hand side of the housing 1 in the drawing a connection is similarly produced between the annular grooves 9 and 12, so that the pressure medium flowing off from the consumer 11 can flow through the line 10, the annular grooves and 12 into the return line 14. On the left-hand side of the housing in the drawing the pressure in the annular groove 9 is reduced by throttling in accordance with the force of the spring 35 and passes through the inclined transverse hole 30 into the annular groove 16 and thus into the control pressure signal line 37. Thus far, the arrangement belongs to the known state of the art.

In its zone facing the middle of the valve piston 3, the auxiliary piston 31 has a transverse hole 41 that is connected with a longitudinal hole 42, 43, 44, the narrowest part of which 42 exerts a throttling action. Transverse holes 46 go out from the part 44 of the longitudinal hole 42, 43, 44 and they empty into an annular groove 47 of the auxiliary piston 31.

Farther from the middle of the valve piston 3, additional transverse holes 48 empty into this annular groove. The annular groove 47 is connected with the annular groove 26 in the inner hole 20 of the valve piston 3, from which the narrow transverse holes 27 and 28, which form the restrictors, depart. Transverse holes 50 and 51 are also provided in the auxiliary piston 31.

The mode of operation is as follows: The pressure in the transverse hole 25 when the latter is connected with the annular groove 9 is distributed through the transverse hole 41 to the narrowed portion 42 of the longitudinal hole 42, 43, 44, such that this narrowed part 42, which constitutes a restrictor, has pressure medium flowing through it in a throttled manner. The pressure medium flows through this restrictive narrowing 42 into the inner chamber of the longitudinal hole 44 and from there through the transverse holes 46 and 27 and 28 into the annular groove 12 and thus into the drain line 14, on the one hand, and through the inclined transverse hole 30 into the annular groove 16 and thus into the control pressure signal line 17, on the other. It should be noted here that during the displacement of the valve piston 3 from the neutral position shown in the drawing by a small amount to the right, the two transverse holes 27 and 28 are still open at first. With increasing displacement the transverse hole 27 is first throttled and then completely covered by the inner wall of the hole 2 and finally a throttling action is also produced at the mount of the transverse hole 28.

The function is thus as follows: The pressure in the longitudinal hole 44 is fed as a pressure signal through the inclined transverse hole 30 and the annular space 16 into the control pressure signal line 17. The pressure in the longitudinal hole 44 is however dependent on how sharply the pressure medium is restricted in flowing out from this longitudinal hole 44 through the transverse holes 27 and 28 in the valve piston 3 and this degree of throttling is in turn dependent on the extent of displacement of the valve piston 3. A throttling chain is thus formed by the narrowed portion 42 of the longitudinal hole, which acts as a restrictor, and by the restrictive holes 27 and 28 and in particular by the throttling at their mouth. The pressure between these two restrictors 42 on the one hand and 27 and 28 on the other is then conveyed into the annular groove 16. Thus, the pressure signal in the control pressure line 17 is no longer merely dependent on the pressure in the line 10 leading to the consumer 11, but is also dependent on the extent of displacement that is arbitrarily imposed on the valve piston 3, but which in turn also determines the throttling on the path of the fluid between the annular groove 6 and the annular groove 9 and thus determines the pressure in the annular groove 9 and the line 10 leading to the consumer 11 and thus determines the stream flowing to the consumer 11, because the extent of the displacement arbitrarily imparted to the valve piston 3 in a specification of the desired value for the moving speed of the consumer 11, to which a control pressure signal synchronization is thus assigned.

An additional piston 55, whose front portion (on the right in the drawing) fits into the reduced part 43 of the longitudinal hole 42, 43, 44, is also capable of sliding in the longitudinal hole 44. The additional piston 55 thus forms a 3-connection/2-position multiway valve, which in the closed position blocks the connection through the dipping of the additional piston 55 into the hole section 43 if a higher control pressure is present in the annular groove 16 from another consumer than in the annular groove 9 that is assigned to the consumer 11, so that in this case it is not the pressure in the annular groove 9, but the pressure at the other consumer (not shown in the drawing) carrying the higher pressure that determines the pressure level in the control pressure signal line 17, while if no other consumer carries a higher pressure than the consumer 11, the pressure in the longitudinal hole section 42 displaces the additional piston 55 toward the outer end of the valve piston 3 and thus releases the connection described above.

In the foregoing specification I have set out certain preferred practices and embodiments of this invention, however, it will be understood that this invention may be otherwise embodied within the scope of the following claims.

I claim:

1. Multiway acting valve for a load sensing-regulated drive system with a housing with a longitudinal bore, a first annular groove intermediate the ends of said bore adapted to be connected to a pump, a pair of second grooves in said bore on opposite sides of said first groove and adapted to be connected with a consumer to be controlled, a pair of third annular grooves on opposite sides of said second grooves and adapted to be connected with a drain line, a pair of fourth annular grooves on opposite sides of said third grooves and adapted to be connected with a control pressure signal line, a valve piston having a longitudinal hole located on at least one side movable in said bore, spaced transverse holes in the valve piston communicating with said longitudinal hole and through which a connection between the first annular groove connected with the pump and one of the pair of second annular grooves connected with the consumer and one of the pair of third annular grooves connected with the drain and through which a connection between one of the pairs of second annular grooves connected with the consumer and one of the fourth annular grooves connected with the control pressure signal line is produced on movement of the valve piston in the bore characterized in that a pressure-reducing element that reduces the pressure conveyed to the connection with the control pressure signal line and which is controlled as a function of the displacement path of the valve piston is located in the connection produced by the annular grooves connected with the consumer with the annular grooves connected with the control pressure signal line.

2. Multiway valve according to claim 1, in which the connection between the annular grooves is controlled by an auxiliary piston slidable in the longitudinal hole in the valve piston.

3. A multiway valve as claimed in claim 2 wherein, in an operative position of the valve piston, a connection is provided between the first groove and one of the pair of second grooves and between one of the pair of third grooves and one of the pair of fourth grooves by means of a longitudinal hole in the auxiliary piston, a fixed restrictor in said longitudinal hole between the first groove and said one of the pair of second grooves and a variable restrictor between said one of the pair of third grooves and said one of the fourth grooves, said variable restrictor restricting flow of fluid as a function of the displacement of the valve piston.

4. Multiway valve according to claim 3, characterized in that a transverse hole is provided in the auxiliary piston, said hole being continuously connected with a transverse hole in the valve piston, which in the operative state produces a conection between said pump and consumer, and to which the longitudinal hole of the auxiliary piston is connected, in which case at least one part of this longitudinal hole is designed as the fixed restrictor.

5. Multiway valve according to claim 4, characterized in that a second transverse hole connecting to the longitudinal hole in the auxiliary piston is connected with an annular groove in said auxiliary piston, which is connected with at least one transverse hole in the valve piston, in which case the mouth of this transverse hole located in the valve piston is capable of being more or less covered by the wall of the bore in the housing depending on the displacement position of the valve piston.

6. A multiway valve as claimed in claims 1 or 2 or 3 or 4 cr 5 wherein the valve piston has a longitudinal hole in each end.

* * * * *

UNITED STATES PATENT AND TRADEMARK OFFICE

CERTIFICATE OF CORRECTION

PATENT NO. : 4,738,279

DATED : April 19, 1988

INVENTOR(S) : Walter Kropp

It is certified that error appears in the above-identified patent and that said Letters Patent is hereby corrected as shown below:

Column 3, line 21 change "is" to --in--.

Column 3, line 33 change "12" to --9--.

Column 3, line 38 change "37" to --17--.

Column 6, line 30 change "claims" to --claim--.

Signed and Sealed this

Twenty-second Day of November, 1988

*Attest:*

*Attesting Officer*

DONALD J. QUIGG

*Commissioner of Patents and Trademarks*